US006937214B2

(12) United States Patent
Chen et al.

(10) Patent No.: US 6,937,214 B2
(45) Date of Patent: Aug. 30, 2005

(54) METHOD FOR GENERATING UNIFORM LUMINOSITY FOR DISPLAYING CONTENTS OF ORGANIC LIGHT EMITTING DIODE

(75) Inventors: Yen-Hua Chen, Taichung (TW); Chih-Chung Chien, Taichung (TW)

(73) Assignee: Wintek Corporation, Taichung (TW)

( * ) Notice: Subject to any disclaimer, the term of this patent is extended or adjusted under 35 U.S.C. 154(b) by 274 days.

(21) Appl. No.: 10/330,294

(22) Filed: Dec. 30, 2002

(65) Prior Publication Data

US 2003/0122751 A1 Jul. 3, 2003

(30) Foreign Application Priority Data

Dec. 31, 2001 (TW) ..... 90133353 A

(51) Int. Cl.[7] ..... G09G 3/30

(52) U.S. Cl. ..... 345/76; 345/46; 345/82; 345/74.1; 315/169.3

(58) Field of Search ..... 345/45, 46, 74.1, 345/76, 82, 169.1, 169.3; 315/169.1, 169.3

(56) References Cited

U.S. PATENT DOCUMENTS 6,337,542 B1 * 1/2002 Hanaki et al. ..... 315/169.3

FOREIGN PATENT DOCUMENTS

JP 64073390 A * 3/1989 ..... G09G/3/30
JP 08248922 A * 9/1996 ..... G09G/3/32

* cited by examiner

*Primary Examiner*—Alexander Eisen
*Assistant Examiner*—Kimnhung Nguyen
(74) *Attorney, Agent, or Firm*—Birch, Stewart, Kolasch & Birch, LLP

(57) ABSTRACT

A method for generating an uniform luminosity for displaying contents on an organic light emitting diode display device that include a plurality of pictures and a plurality of pixels has a driver circuit in the display device to light the pictures and pixels. The method includes: (A) setting a unit time which is the time of the driver chip to scan every pixel; (B) calculating the multiple of the area of every picture; (C) obtaining the multiple of the maximum area; and (D) calculating the multiple of the area of every picture according to step (B).

4 Claims, 4 Drawing Sheets

METHOD FOR GENERATING UNIFORM LUMINOSITY FOR DISPLAYING CONTENTS OF ORGANIC LIGHT EMITTING DIODE

This nonprovisional application claims priority under 35 U.S.C. §119(a) on Patent Application No. 090133353 filed in TAIWAN, R.O.C. on Dec. 31, 2001, which is herein incorporated by reference.

FIELD OF THE INVENTION

The present invention relates to a displaying technique for organic light emitting diode (OLED) and particularly a method for generating an uniform luminosity for displaying contents on a display device by controlling driving signals of an OLED driver circuit.

BACKGROUND OF THE INVENTION

At present OLED has been used in many applications such as car display devices, game players, PDAs, mobile phones, and the like. Displaying contents generally include pictures and characters composed of pixels. Refer to FIG. 1A for a conventional OLED display device including a driver circuit diagram for a passive and an active OLED. The driver circuit is built in a driver chip 10 to drive a plurality of pictures 12, 13, 14, 15, and 16 and a plurality of pixels 17 located on a display panel 11.The driver chip 10 outputs current signals through data lines 100 and scanning signals through scanning lines 101 to provide a constant electric current to drive the pictures and pixels. As the driver circuit shown in FIG. 1A supplies a constant electric current, the larger picture will have a dimmer luminosity while the smaller picture will has a stronger luminosity. As a result, the whole display picture has an uneven luminosity.

Refer to FIG. 1B for the driver circuit diagram of another conventional OLED display device. It is an improved circuit over the one shown in FIG. 1A. It has another driver chip 18 to provide a greater electric current to the pictures 12, 13, 14, 15 and 16 to remedy the dimmer luminosity problem occurred to larger display pictures. However, the addition of an extra driver chip increases the cost. Moreover, more signal lines are needed, and more line configuration space is required on the display panel.

SUMMARY OF THE INVENTION

The primary object of the invention is to resolve the aforesaid problem of uneven luminosity that occurs to the conventional OLED display devices, and to reduce the design cost and line configuration space on the display panel.

In order to achieve the foregoing objects, the method to achieve uniform luminosity for displaying contents of the OLED display devices of the invention aims at displaying contents that include a plurality of pictures and a plurality of pixels and an OLED display device which has a driver chip to light the pictures and the pixels. The method includes the steps of: (A) setting a unit time which is the time required for the driver chip to scan every pixel; (B) calculating the multiple of the area of every picture and obtaining the maximum area multiple, wherein the area multiple of every picture is the ratio of the area of every picture and the area of one pixel; (C) based on the maximum area multiple obtained at step (B), the driver chip simultaneously provides a first scanning signal to every picture, the time period of supplying the first scanning signal is the unit time times the maximum area multiple; (D) based on the area multiple of every picture obtained at step (B), and during the driver chip simultaneously provides the first scanning signal to every picture, the driver chip also provides respectively a first current signal to every picture, the time period of supplying the first current signal is the unit time times the area multiple of every picture.

The method set forth above further includes: the driver chip provides a second scanning signal to every pixel. The time period of supplying the second scanning signal is the unit time at step (A). While the driver chip supplies the second scanning signal to every pixel the drive chip also supplies a second current signal to every picture, the time period of supplying the second current signal is the unit time at step (A).

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1A:
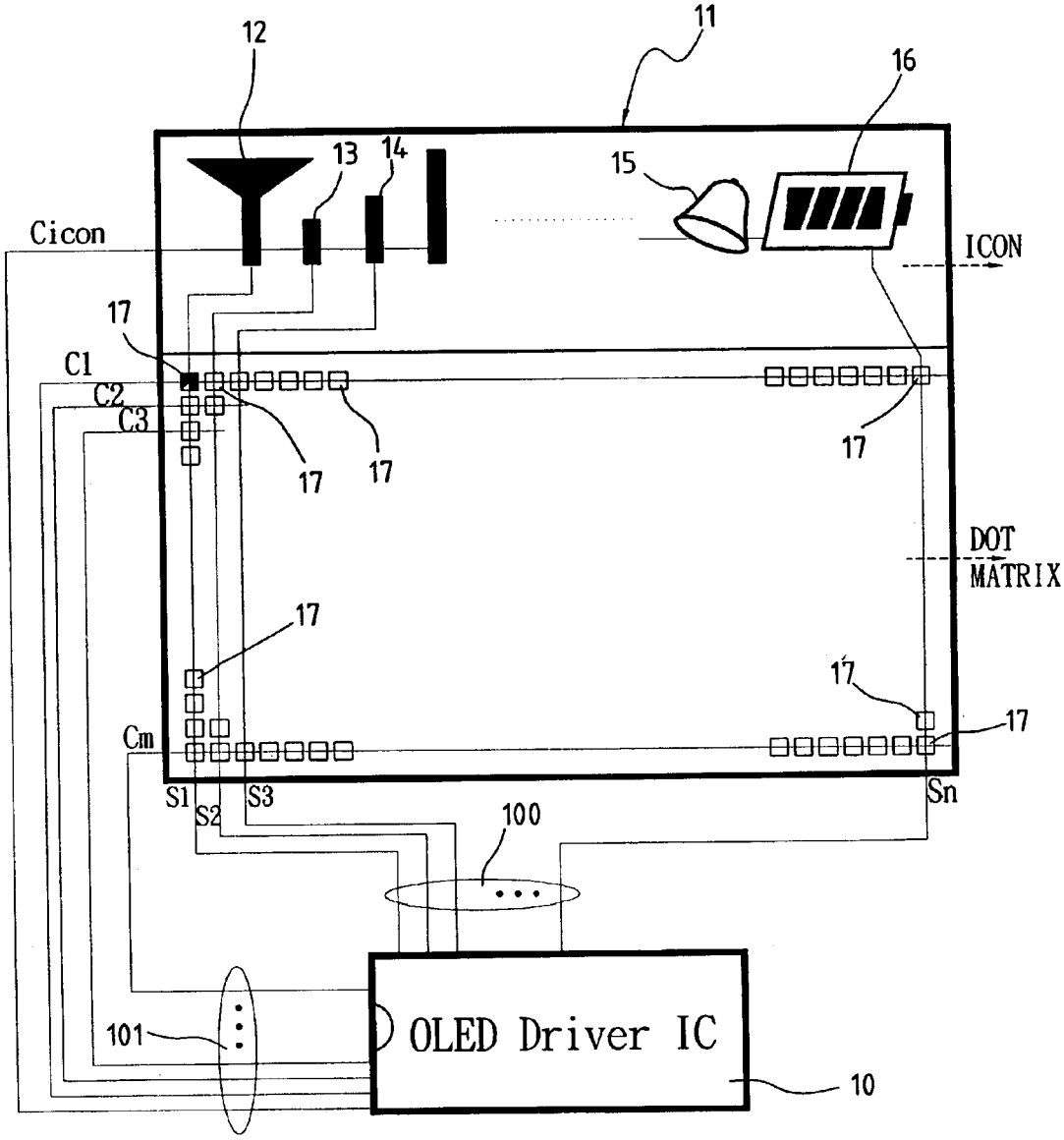
Fig. 1A Prior Art
FIG. 1A is a schematic view of a driver circuit of a conventional OLED display device.

The invention, in principle, is to control the scanning line signals and data line signals of a driver chip shown in FIG. 1A, and based on the size of the display area to determine the signal supply time. In general, the larger the area size, the longer the signal supply time; and the smaller the area size, the shorter the signal supply time. The rationale is that the larger displaying area requires more power and signals are supplied at a longer period of time, while the smaller displaying area requires less power, thus signals are supplied at a shorter period of time. Finally, every displaying area has even power density and every displaying area has an even luminosity. The display device may be a passive OLED display device or an active OLED display device.

Figure 2:
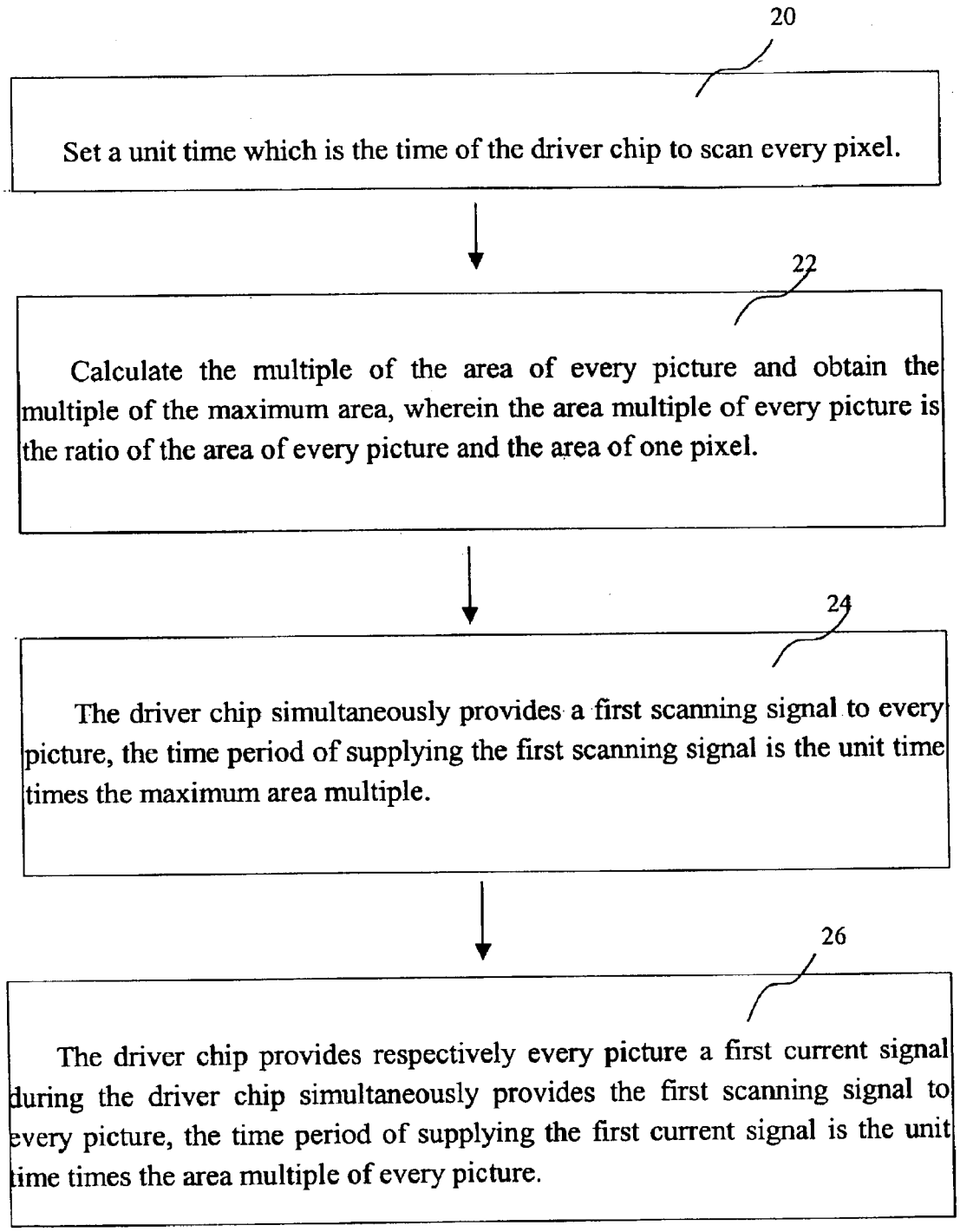
FIG. 2 is the process flow chart of the method of the invention.

Refer to FIG. 2 for the process flow of the invention. Step 20 is setting a unit time which is the time of the driver chip to scan every pixel. Step 22 is calculating the multiple of the area of every picture and obtaining the multiple of the maximum area, wherein the area multiple of every picture is the ratio of the area of every picture and the area of one pixel. Step 24 is that the driver chip simultaneously provides a first scanning signal to every picture based on the maximum area multiple obtained at step 22, the time period of supplying the first scanning signal is the unit time times the maximum area multiple. Step 26 is that the driver chip provides respectively a first current signal to every picture based on the area multiple-obtained at step 22 during the driver chip simultaneously provides the first scanning signal to every picture, and the time period of supplying the first current signal is the unit time times the area multiple of every picture. The method of the invention further includes the following steps: the driver chip provides a second scanning signal to every pixel. The time period of supplying the second scanning signal is the unit time at step 20. While the driver chip supplies the second scanning signal to every pixel the drive chip also supplies a second current signal to every picture, and the time period of supplying the second current signal is the unit time at step 20.

At step 24 set forth above, as a plurality of pictures share one scanning line, the scanning time must use the time of the picture of the largest area to enable the largest picture to obtain power needed to display the complete picture and achieve the uniform luminosity effect.

Figure 1B:
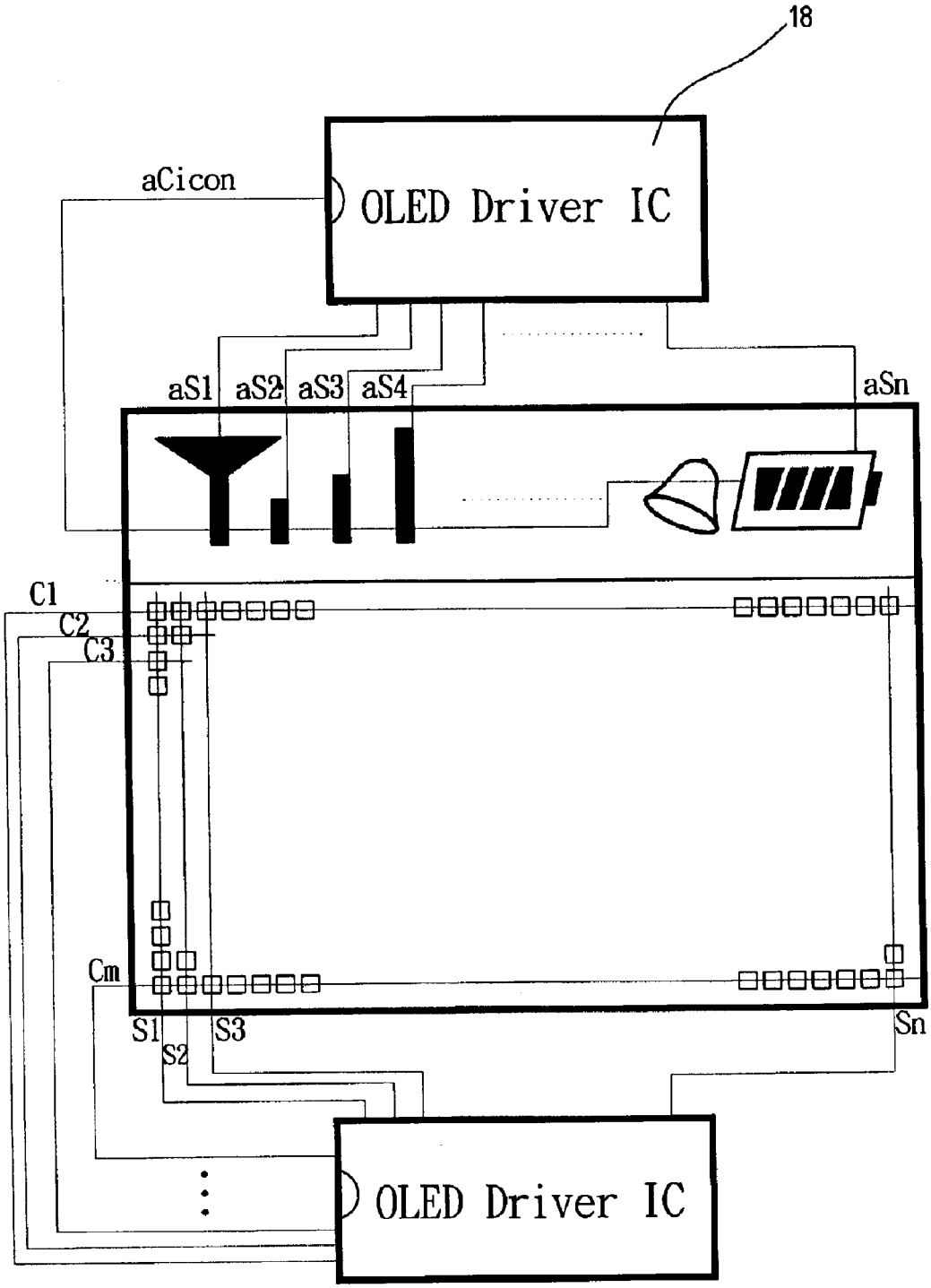
Fig. 1B Prior Art
FIG. 1B is a schematic view of a driver circuit of anther conventional OLED display device.
Figure 3:
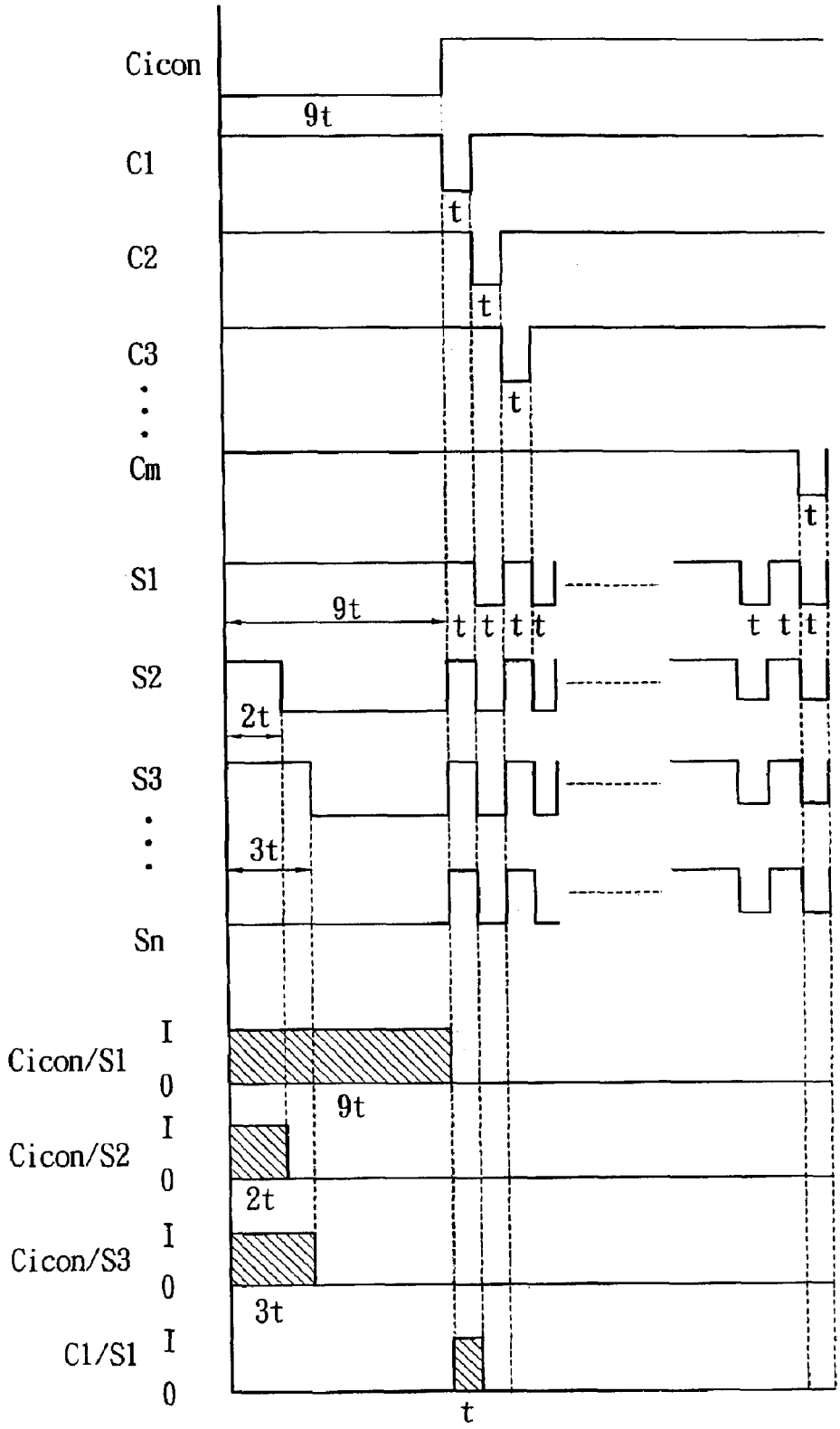
FIG. 3 is a schematic view of an embodiment of the invention, showing various driving signal wave forms adopted on the driver chip shown in FIG. 1A.

Refer to FIG. 3 for various driving signal wave forms of an embodiment of the method of the invention adopted on the driver chip shown in FIG. 1A. FIG. 3 is designed based on FIG. 1, picture 12 has area multiple 9, picture 13 has area multiple 2, picture 14 has area multiple 3, and the driver chip 10 supplies a constant electric current I. As shown in FIG. 3, the unit time is t, i.e. time required for the driver chip 10 to scan every pixel 17 is t. Signal supplying time of the scanning line Cicon is 9t. It means that the scanning time for the largest picture (picture 12) is 9t. The shadow area represents power obtained by each picture and pixel. Thus picture 12 has power (I×9t), picture 13 has power (I×2t), and picture 14 has power (I×3t).

Trough a simple calculation, it shows that pictures 12, 13 and 14 and the pixel 17 all have power density (I×t). Thus all have the same luminosity and the display contents also have the same luminosity.

By means of the method set forth above, the invention uses one driver ship to achieve uniform luminosity for the displaying contents and saves the cost of an additional chip that might otherwise require. In addition, the invention requires fewer signal lines and saves the line configuration space on the display panel. Thus the invention enables the OLED display device to be made at a lower cost, less weight and to be more effective in terms of dimension utilization.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A method for generating an uniform luminosity for displaying contents on an organic light emitting diode display device that include a plurality of pictures and a plurality of pixels, the organic light emitting diode display device having a driver chip to light the pictures and the pixels, the method comprising steps of:

setting a unit time which is the time of the driver chip to scan each of the pixels;

calculating a ratio of an area of each of the pictures and an area of one pixel;

obtaining maximum ratio from the ratio of the pictures, providing simultaneously a first scanning signal by the driver chip to each of the pictures based on the maximum ratio, the first scanning signal being provided for a first period of time, the first period of time being a multiplication of the unit time and the maximum ratio; and providing respectively a first current signal to each of the pictures by the driver chip based on the ratio of each of the pictures when the driver chip simultaneously provides the first scanning signal to each of the pictures, each of the first current signals being providing a second period of time, the second period of time being a multiplication of the unit time and the ratio of each of the pictures.

2. The method of claim 1, further including providing a second scanning signal each of the pixels by the driver chip, the second scanning signal being provided for the unit time, the driver chip supplying a second current signal to each of the pictures while supplying the second scanning signal to each of the pixels, the second current signal being provided for the unit time.

3. The method of claim 1, wherein the organic light emitting diode display device is a passive organic light emitting diode display device.

4. The method of claim 1, wherein the organic light emitting diode display device is an active organic light emitting diode display device.

* * * * *